US006682289B1

(12) United States Patent
Credle, Jr.

(10) Patent No.: US 6,682,289 B1
(45) Date of Patent: Jan. 27, 2004

(54) DISPENSING APPARATUS AND METHOD OF USING SAME

(75) Inventor: William S. Credle, Jr., Roswell, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/958,011

(22) PCT Filed: Mar. 31, 2000

(86) PCT No.: PCT/US00/08887

§ 371 (c)(1),
(2), (4) Date: Oct. 1, 2001

(87) PCT Pub. No.: WO00/60553

PCT Pub. Date: Oct. 12, 2000

Related U.S. Application Data

(60) Provisional application No. 60/127,629, filed on Apr. 2, 1999.

(51) Int. Cl.[7] ..... G07F 11/42

(52) U.S. Cl. ..... 414/281; 414/268; 414/276; 221/95; 221/133; 221/195

(58) Field of Search ..... 221/195, 133, 221/95; 414/268, 276, 281

(56) References Cited

U.S. PATENT DOCUMENTS

| | | | | |
|---|---|---|---|---|
| 3,536,194 A | * | 10/1970 | Novak | 209/80.5 |
| 3,557,940 A | * | 1/1971 | Rogers et al. | 198/157 |
| 4,190,179 A | | 2/1980 | Moss et al. | 221/299 |
| 4,717,044 A | * | 1/1988 | Suzuki et al. | 221/130 |
| 4,734,005 A | * | 3/1988 | Blumberg | 414/273 |
| 4,867,628 A | | 9/1989 | Ammon et al. | 414/273 |
| 5,105,978 A | * | 4/1992 | Trouteaud et al. | 221/150 R |
| 5,139,384 A | | 8/1992 | Tuttobene | 414/281 |
| 5,240,139 A | * | 8/1993 | Chirnomas | 221/2 |
| 5,791,516 A | | 8/1998 | Wittern, Jr. et al. | 221/301 |
| 5,881,911 A | | 3/1999 | Burdette et al. | 221/131 |
| 6,112,497 A | | 9/2000 | Credle, Jr. | 53/48.5 |
| 6,199,720 B1 | | 3/2001 | Rudick et al. | 21/6 |
| 6,206,234 B1 | * | 3/2001 | Rawlins | 221/195 |

FOREIGN PATENT DOCUMENTS

DE 94 16 212 U 2/1995

OTHER PUBLICATIONS

Royal Vendors, Inc. Brochure entitled "GIII".
Wurlitzer Brochure entitled "The 1 Stop Lunch Shop".

* cited by examiner

*Primary Examiner*—Steven A. Bratlie
(74) *Attorney, Agent, or Firm*—Sutherland Asbill & Brennan LLP

(57) ABSTRACT

A vending machine for vending articles, most notably beverage or food containers. More particularly, the present invention relates to a vending machine having a cabinet with a plurality of vertically spaced shelves, and an "X-Y" picker assembly for receiving a packaged beverage from a shelf and for delivering the packaged beverage to a delivery port in a front face of the cabinet, or to another location as desired.

21 Claims, 12 Drawing Sheets

PICKING STEP BEGINS

INITIAL ENGAGEMENT

TARGET CAN PICKED,
NEXT CAN BLOCKED

PICKING STEP COMPLETE

PREFERRED EMBODIMENT

DISPENSING APPARATUS AND METHOD OF USING SAME

CROSS REFERENCE TO RELATED APPLICATIONS

The present application incorporates by reference and claims the priority of pending provisional patent application No. 60/127,629, filed Apr. 2, 1999.

TECHNICAL FIELD

The present invention relates to a vending machine for vending articles, most notably beverage or food containers. More particularly, the present invention relates to a vending machine having a cabinet with a plurality of vertically spaced shelves, and an "X-Y" picker assembly for receiving a packaged beverage from a shelf and for delivering the packaged beverage to a delivery port in a front face of the cabinet, or to another location as desired.

BACKGROUND OF THE INVENTION

Various vending machines are known which dispense articles from shelves or storage bins. Conventionally, the dispensed articles fall, under the influence of gravity, away from the shelf or storage bin. A chute is typically located in the path of the falling article and directs the falling article to a discharge port located beneath the shelves or storage bins.

Such conventional vending machines do not fully utilize the interior space of the vending machine. Since gravity is used to deliver the article to the discharge pork the space adjacent and beneath the discharge cannot be used to store vendable articles. Therefore, the discharge port is typically located in the lower portion of the vending machine, which may not always be suitable for the users.

In such prior art dispensing apparatuses, there may also be multiple escapement mechanisms, one for each row of products, which are configured to dispense one of the products iron the front of each row. As may be understood, such escapement mechanisms tend to add to the cost and burden the reliability of the forty-five (45) separate escapement mechanisms.

Other known devices include U.S. Pat. No. 4,867,628 and German Patent No. DE-U-946212. The U.S. reference shows a dispenser that moves an article in or out of a storage compartment via a bin. The bin is operable in the Z-direction via a slide guide. The German reference apparently shows a dispenser that removes an article from a storage compartment via a piercing device that moves in the Z-direction.

Glass door vendors include a glass door on the front, with the glass door being opened from the front by the servicing personnel. This allows the servicing personnel to access the products through a front opening. Products are also visible by the consumer, which is an advantage. However, packout is also a consideration in the building of the devices, especially if the products are standing upright, and have different heights. In such a situation the highest product on a particular shelf may result in poor packout if other lower products are used within the same shelf. Furthermore, the gear motors are used To drive the coils in each of the product dispensing areas in the glass door vendors again tend to add to the cost and burden the reliability of the overall dispensing apparatus.

However, the glass door vendors do have advantages; when a customer walks up to a glass door vendor, he/she can see whether or not there is product in the machine. If a customer cannot see the product, there may be some hesitation on behalf of the customer to use the vendor. The known dispensing devices described above would not be useful in the glass door vendor applications because The dispensers would block the view of the customer to the products.

Therefore, there is a need in the art for an improved product vending apparatus which allows for viewing of the products, provides improved packout, and accommodates a variety of dispensing schemes, while still remaining cost-efficient and reliable.

SUMMARY OF THE INVENTION

The present invention overcomes deficiencies in the prior art by providing an improved product vending apparatus which allows for viewing of the products, provides improved packout, and accommodates a variety of dispensing schemes, while still remaining cost-efficient and reliable.

Generally described, the invention is directed towards an apparatus for storing and dispensing a plurality of products, the apparatus comprising a frame, a plurality of storage locations for storing the products, a discharge location, and a picking apparatus configured to withdraw the products from any one of the storage locations, transport them singularly for a distance, and dispense them into the discharge location.

Therefore it is an object of the present invention to provide an improved dispensing apparatus and method of using same.

It is a further object of the present invention to provide an improved dispensing apparatus which allows for viewing of the products.

It is a further object of the present invention to provide an improved dispensing apparatus which provides improved pack-out.

It is a further object of the present invention to provide an improved dispensing apparatus which accommodates a variety of dispensing schemes.

It is a further object of the present invention to provide an improved dispensing apparatus which is cost-efficient to manufacture and operate.

It is a further object of the present invention to provide an improved dispensing apparatus which is reliable.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Reference is now made to the drawings, in which like numerals designate like elements throughout the several views shown in FIGS. 1–5.

General Discussion of Method and Apparatus

Figure 1:
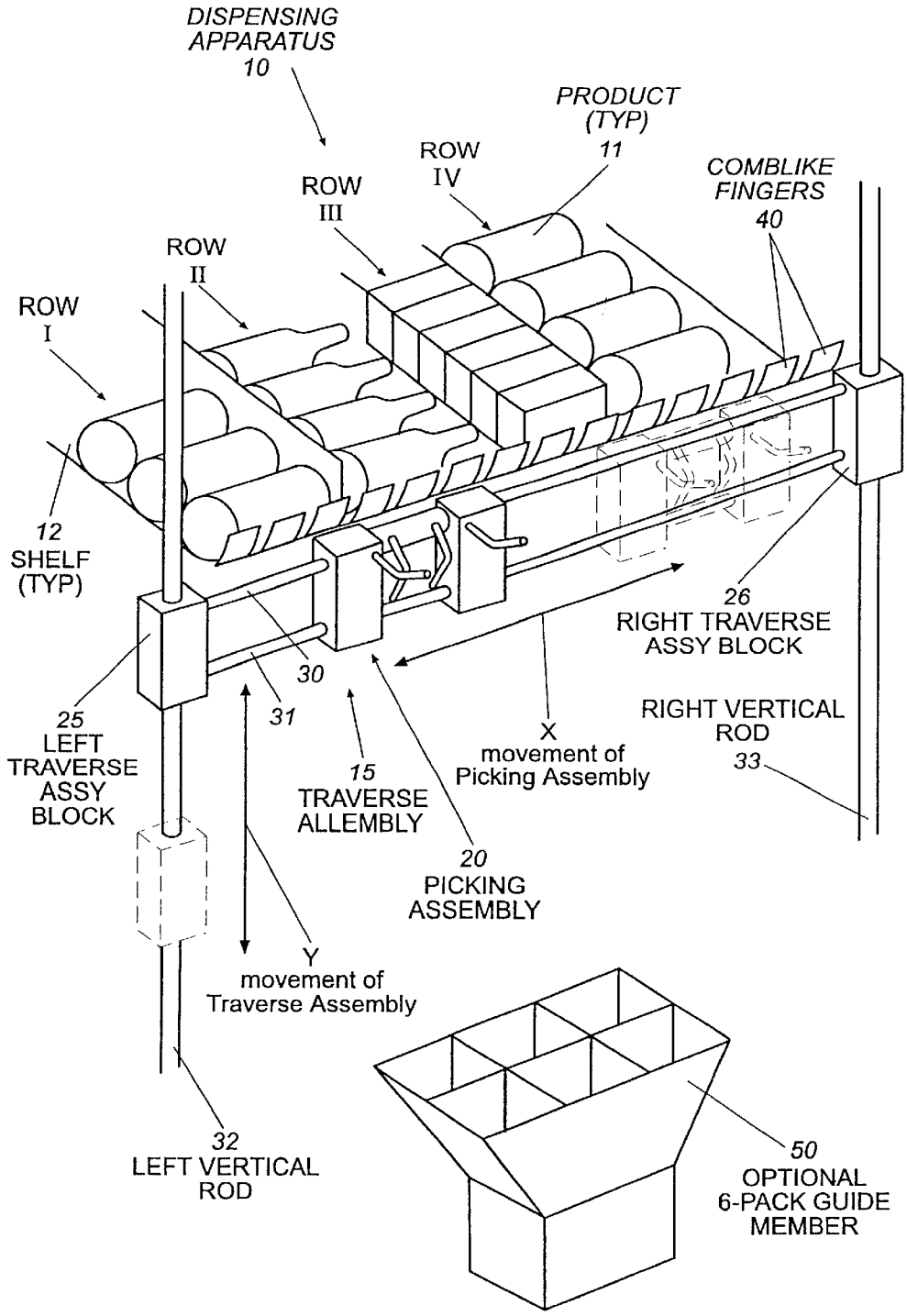
FIG. 1 is an illustrative view of a dispensing apparatus 10 which dispenses a plurality of different products 11 out of various rows I, II, III, and IV, by use of a picking assembly 20 which is part of a X-Y traverse assembly 15. The picking assembly 20 is moved along an "X" axis by its relative movement along upper and lower horizontal rods 30, 31. The horizontal rods have each of their ends mounted in left and right traverse assembly blocks 25, 26. The picking assembly 20 is moved along its "Y" axis by parallel movement of the left and right traverse assembly blocks 25, 26, along corresponding left and right vertical rods 32, 33.

Generally described, the present invention relates to a dispensing apparatus which dispenses products such as cans, bottles, boxes, etc., to a waiting consumer. FIG. 1 is an illustrative view of one such dispensing apparatus 10 which dispenses a plurality of different products 11 out of various rows I, II, III, and IV, by use of a picking assembly 20 which is part of a X-Y traverse assembly 15.

Figure 2:
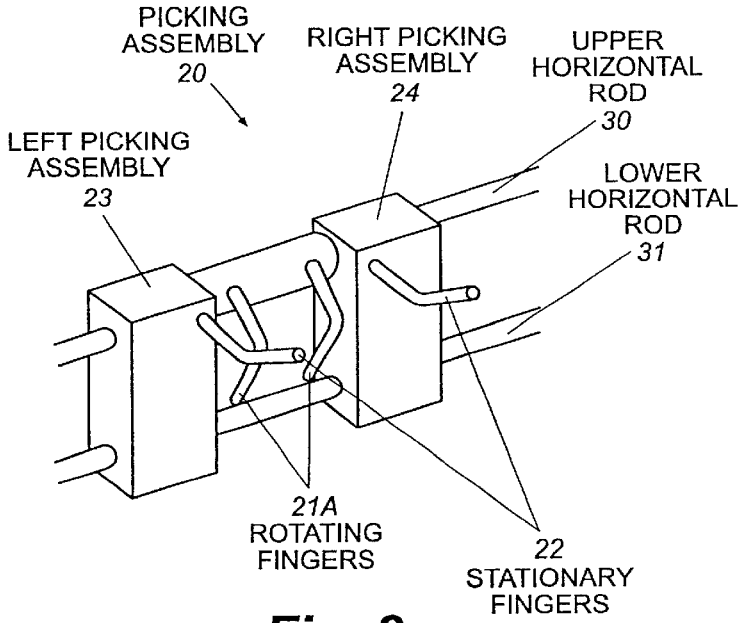
FIG. 2 is a isolated pictorial view of a picking assembly 20 according to the present invention, which includes rotating fingers 21A, stationary fingers 22, and left and right picking assembly block members 23, 24, respectively, each of which engage and move horizontally relatively to the upper and lower horizontal rods 30, 31. The rotating fingers, 21A are first embodiment fingers, as opposed to second and third embodiment fingers 21B, 21C, respectively, discussed elsewhere.

Referring also to FIG. 2, the picking assembly 20 includes rotating fingers 21, stationary fingers 22, and left and right block members 23, 24, respectively, each of which engage and move horizontally relatively to upper and lower horizontal rods 30, 31.

By rotating the rotating fingers 21 of the picking assembly 20, the picking assembly 20 can "pick" a product, move the product to a remote location by means of the X-Y traverse assembly 15, and dispense the product as desired.

The Frame

Figure 5:
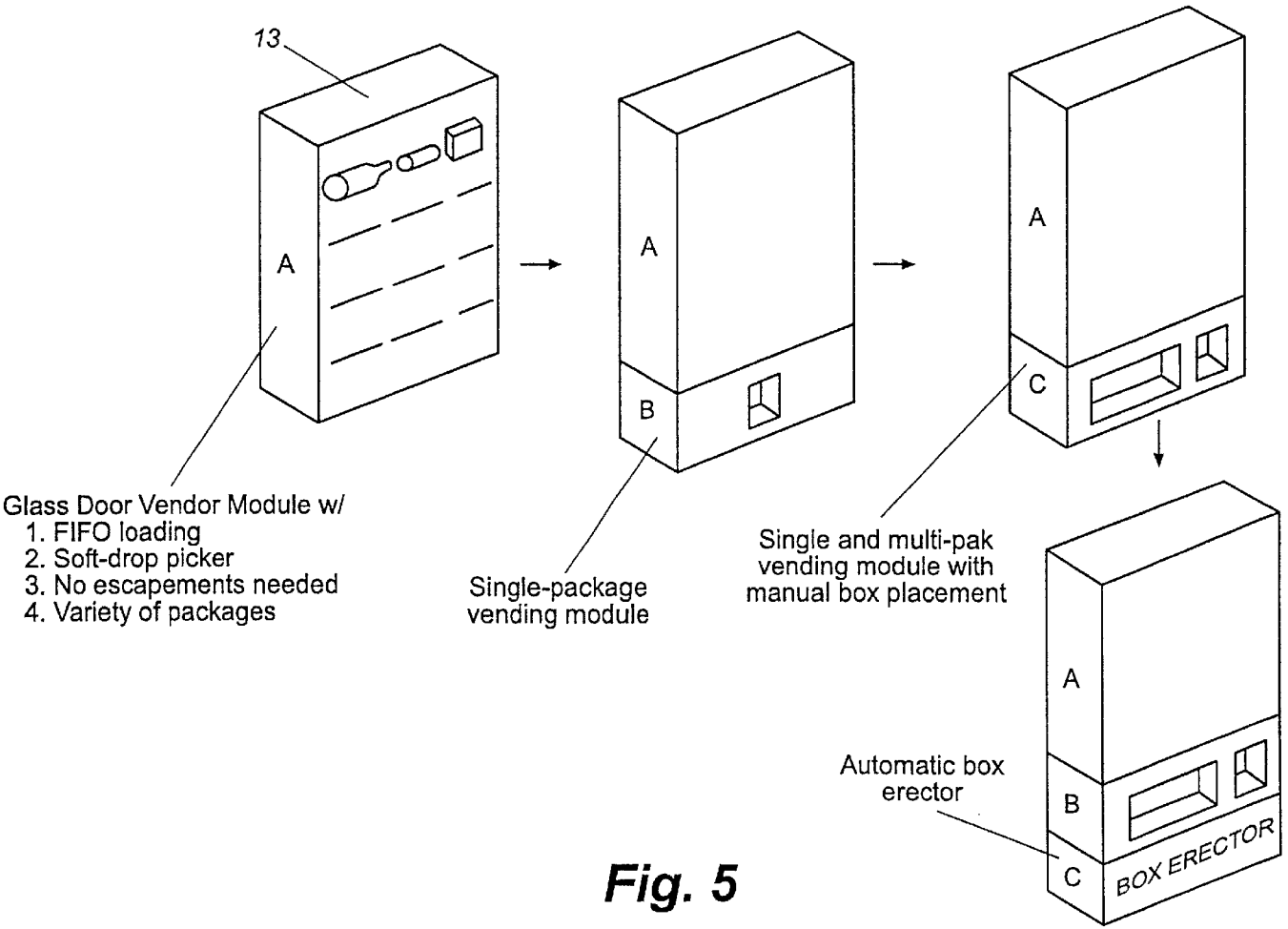
FIG. 5 is an illustrative view of a module A which can be used with other modules B, C, and D.

The frame of the overall dispensing apparatus 10 is shown generally as 13 in FIG. 5. This frame can be as known in the art in that it can provide an enclosure for containing product as well as a framework for supporting various of the other internal components of the apparatus, such as the X-Y traverse assembly 15.

The X-Y Traverse Assembly 15

Referring now to FIG. 1, the X-Y traverse assembly 15 includes the picking assembly 20, and also includes upper and lower horizontal rods 30, 31, left and right traverse assembly blocks 25, 26, and left and right vertical rods 32, 33.

The left and right vertical rods 32, 33, extend in a generally coparallel fashion, and are configured to allow for relative vertical movement of the left and right assembly blocks 25, 26 along their respective heights. This can be done by providing an interaction of the rods 32, 33 and the blocks 25, 26 such as used in conventional X-Y plotter technology.

The horizontal rods 30, 31, have each of their ends mounted in left and right traverse assembly blocks 25, 26. Left and right block members 23, 24, each engage and are configured to be moved horizontally relatively across the upper and lower horizontal rods 30, 31. Again the interaction of the rods 30, 31 and the blocks 23, 24 can be such as used in conventional X-Y plotter technology.

The picking assembly 20 is moved along an "X" axis by its relative movement along upper and lower horizontal rods 30, 31. The picking assembly 20 is moved along its "Y" axis by parallel movement of the left and right traverse assembly blocks 25, 26, along corresponding left and right vertical rods 32, 33.

Such movement along the X and Y axes allow for the picking assembly to select (a.k.a. "pick") products, move to a different location, and subsequently release (a.k.a. "release") them into a single outlet chute (not shown) or into a six-pack container by use of the guide member 50 shown in FIG. 1.

Picking Assembly 20

As noted above, one picking assembly 20 is moved along both an "X" axis and a "Y" axis relative to the frame of the apparatus 10. Referencing FIG. 2 now for more detail, the picking assembly includes not only the previously-discussed left and right picking assembly blocks 23, 24, but also a pair of rotating fingers 21 and a pair of stationary fingers 22.

The pair of stationary fingers 22 are configured to be mounted one each within corresponding left and right picking assembly blocks 23, 24. As will be discussed later, the pair of stationary fingers 22 is configured to provide a "cradle" for the product after it is picked by the rotating fingers 21 but before it is discharged by the picking assembly 20.

The rotating fingers 21 rotate in a single direction (although it may be reversible) with such rotation being around a central, substantially horizontal, axis. This pair of rotating fingers 21 is used to "pick" product from the front of a row of products, with the rotating fingers 21 passing through the comblike fingers 40 in the shelves 12 discussed below.

Besides providing a picking function, as discussed in detail later, the rotating fingers 21 also provide a "block" to the can behind the target can so that the next can does not roll off the shelf under its own momentum.

The Shelves with the Comblike Fingers

Figure 3:
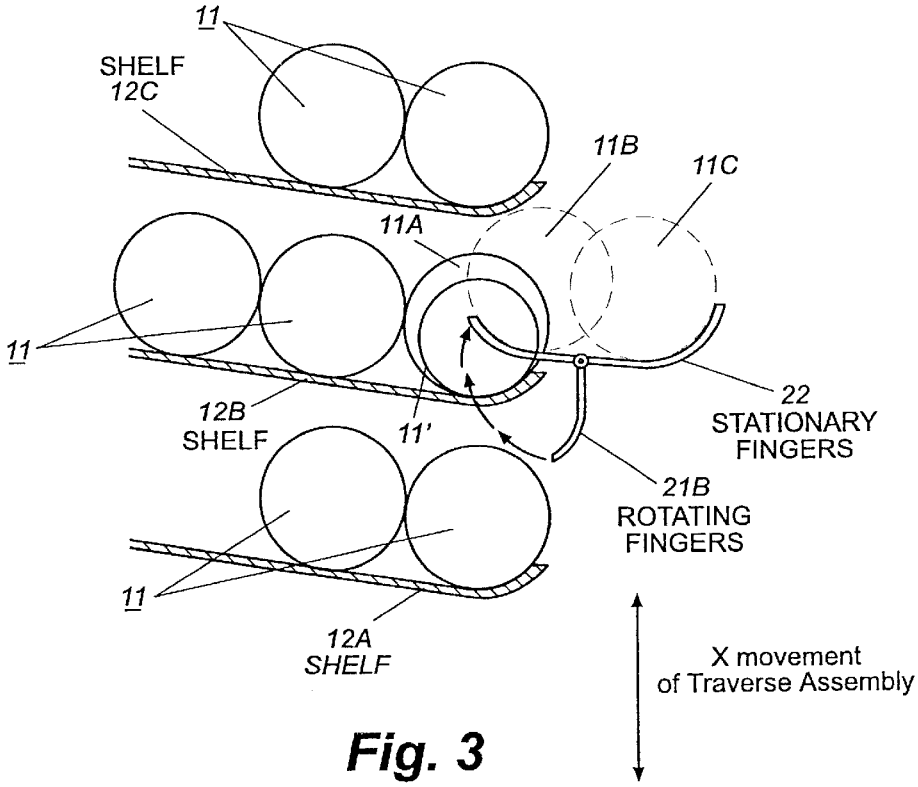
FIG. 3 is a side illustrative view of a plurality of different products 11 loaded atop various shelves 12A, 12B, and 12C, also showing by illustration the relative movement of the rotating fingers 21B as they cooperate with stationary fingers 22 in picking a product 11 and moving it through positions shown as 11-A, 11-B, and 11-C. An alternately (smaller) sized product 11' is also shown to illustrate that the apparatus 10 according to the present invention can accommodate differently sized products.

Reference is now made to FIGS. 1 and 3, in describing the shelves 12 used to contain the products prior to their dispensing. As may be seen in FIG. 1, four rows I, II, III, and IV of products 11 are stored on an exemplary single shelf 12. This shelf is inclined as known in the art and includes dividers as known in the art to provide a plurality of inclined "chutes", which allow product, especially round product, to slide or roll down to the front of the shelf under the influence of gravity (spring pressure may be used to assist rectangular or irregular product as needed).

At the front edge of the shelf is provided a comblike lip configuration provided by a plurality of spaced-apart "fingers", which extend generally upwardly from the front edge of the shelf 12, to provide a retention feature for the front can in each row so that it will not fall off. This retention feature, however, can be overcome by the use of the rotating fingers 21 as noted above, which pass through the comblike fingers 40 and allow for the frontmost product from a particular row to be withdrawn by the picking assembly 20.

Under the present invention there may be more space than fingers in the comb mechanism. However, once programmed the gripper device will be "smart" enough to know where to go to pick the product.

One Picking Process

Reference is made to FIGS. 3 and 4 to describe the relative movement of the rotating fingers 21 as they cooperate with stationary fingers 22 in picking a product 11. FIG. 3 is a side illustrative view of a plurality of different products 11 loaded within various shelves 12A, 12B, and 12C, also showing by illustration the relative movement of the rotating fingers 21 as they cooperate with stationary fingers 22 in picking a product 11 and moving it through positions shown as 11-A, 11-B, and 11-C. An alternately sized product 11' is also shown to illustrate that the apparatus 10 according to the present invention can accommodate differently sized products.

FIGS. 4*a*–4*d* are illustrative side views showing sequential steps in the picking process of the rotating fingers 21 and stationary fingers 22, as a target product 11 is picked, and a "next" product takes its place at the front of the product row.

Figure 4A:
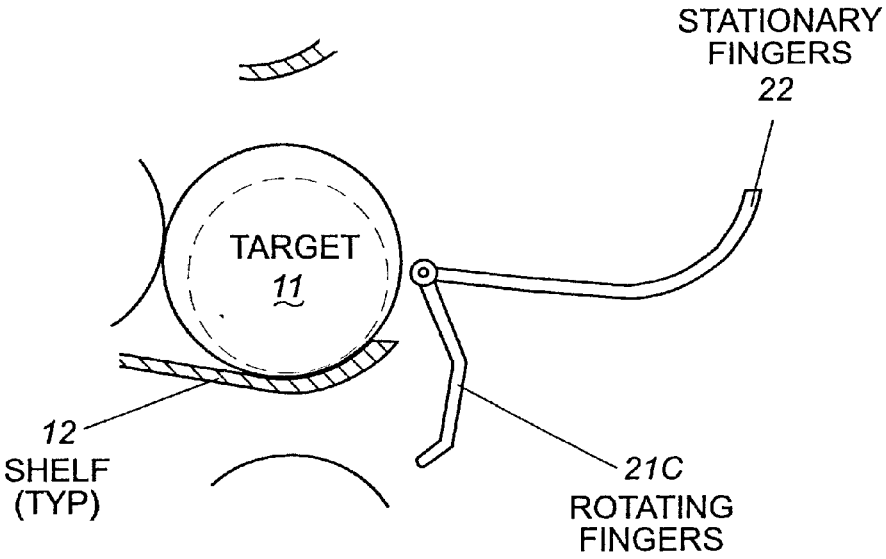
FIGS. 4*a*–4*d* are illustrative side views showing sequential steps in the picking process of the rotating fingers 21C and stationary fingers 22.

In FIG. 4*a*, the rotating fingers 21 are at the "ready" position.

Figure 4B:
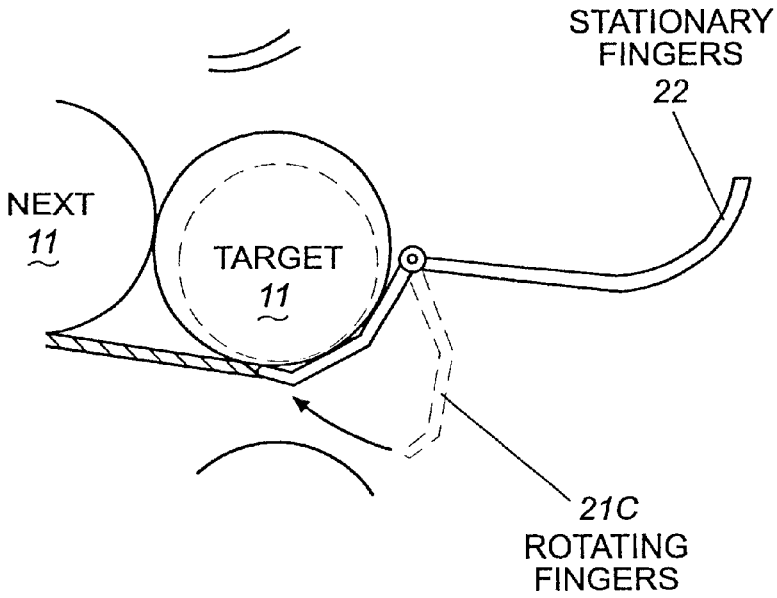

In FIG. 4*b*, the rotating fingers 21 have rotated from the FIG. 4*a* position and are passing through the comblike fingers and are contacting the target product 11.

Figure 4C:
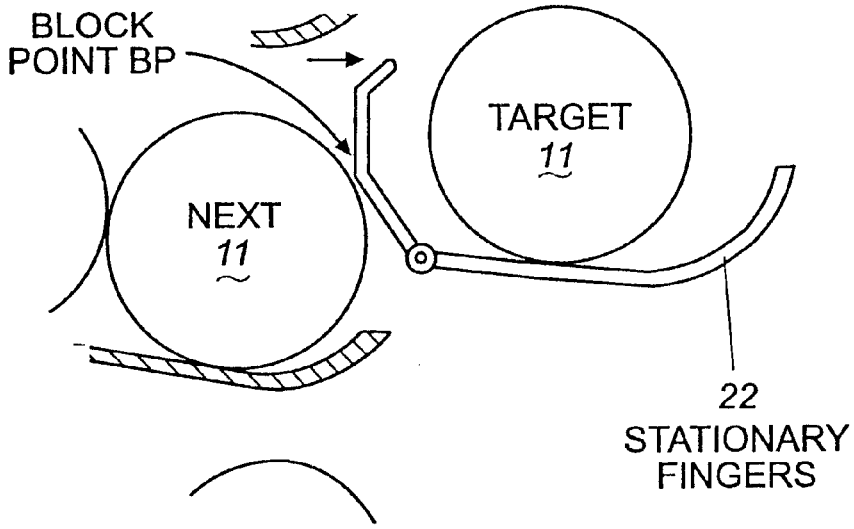

In FIG. 4*c*, the rotating fingers 21 have rotated from the FIG. 4*b* position, and the target product 11 has been removed from its row, and is now being supported by the stationary fingers. At the same time, the rotating fingers 21 are "blocking" the next product which is moving into the place of the now-picked product under the influence of gravity. Such blocking can dissipate the energy in the next product to preclude it from jumping over the comblike lip.

Figure 4D:
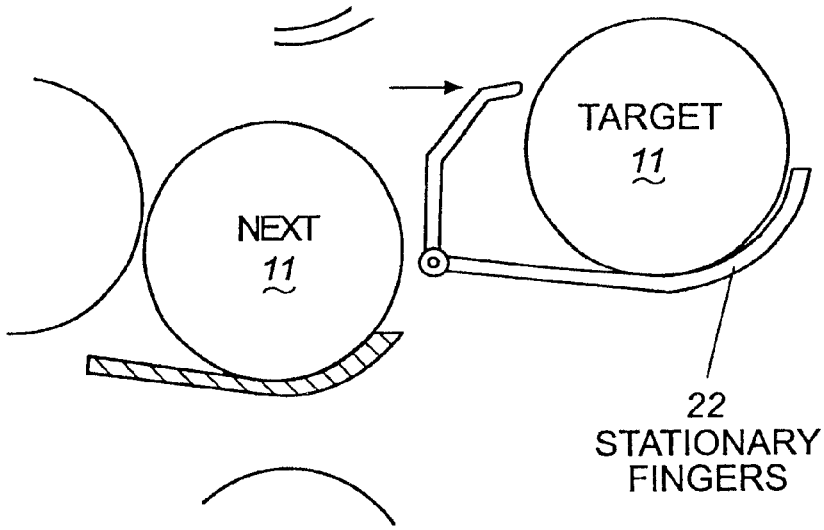

In FIG. 4*d*, the rotating fingers 21 have rotated from the FIG. 4*c* position and the product is cradled and ready to be carried by the picking assembly 20 to be discharged at a remote location. The "next" product is now in place to be picked next if so desired.

It should be understood that in some instances it has been recognized that the shelf above the item being picked sometimes assists retention of the item as it is being picked, in that the shelf above blocks the item from falling out of the rotating fingers.

Discharge Options

Once the products have been picked by the picking assembly 20, they can then be carried by the picking assembly 20 to be discharged at a remote location. Such discharge can take many forms.

One type of discharge can be by bringing the product downwardly until one end contacts a stationary surface, thus tipping the product out of the cradle of the picking assembly 20 such that it can fall under the influence of gravity to a waiting chute or guide member (such as 50 in FIG. 1).

Alternatively, the product could be lowered downwardly on to an inclined ramp, with the inclined ramp being positioned between the two stationary fingers 22.

Alternately, one of the stationary fingers 22 could "drop-out", allowing release of the product without contact with any other device.

Operation of FIG. 1 Configuration with Other Apparatus Modules

Reference is now made to FIG. 5, which shows how one can begin with one machine A, and then the machine can be built upon. FIG. 5 shows different modules. The first picture shows the concept of an "A" module alone. This "A" module could include just an enclosure, shelves, and an X-Y picker assembly.

The second picture (A+B) shows the A module in conjunction with a base module which allows the cans to come out in the front, in the side, or as desired.

The third picture (A+C) shows the A module in conjunction with a base module which allows the cans to come out one at a time in the front, or a multiple pack including multiple products in an erected container could also be provided.

The fourth picture (A+C+D) shows the A module in conjunction with a base module which allows the cans to come out one at a time in the front, or a multiple pack including multiple products in an erected container provided by an on-site erector D could also be provided.

Alternate Picking Apparatus 120—FIGS. 6–10

Reference is now made to FIGS. 6–10, which show an alternate picking apparatus 120 which can be used with an alternate apparatus 200.

Figure 6:
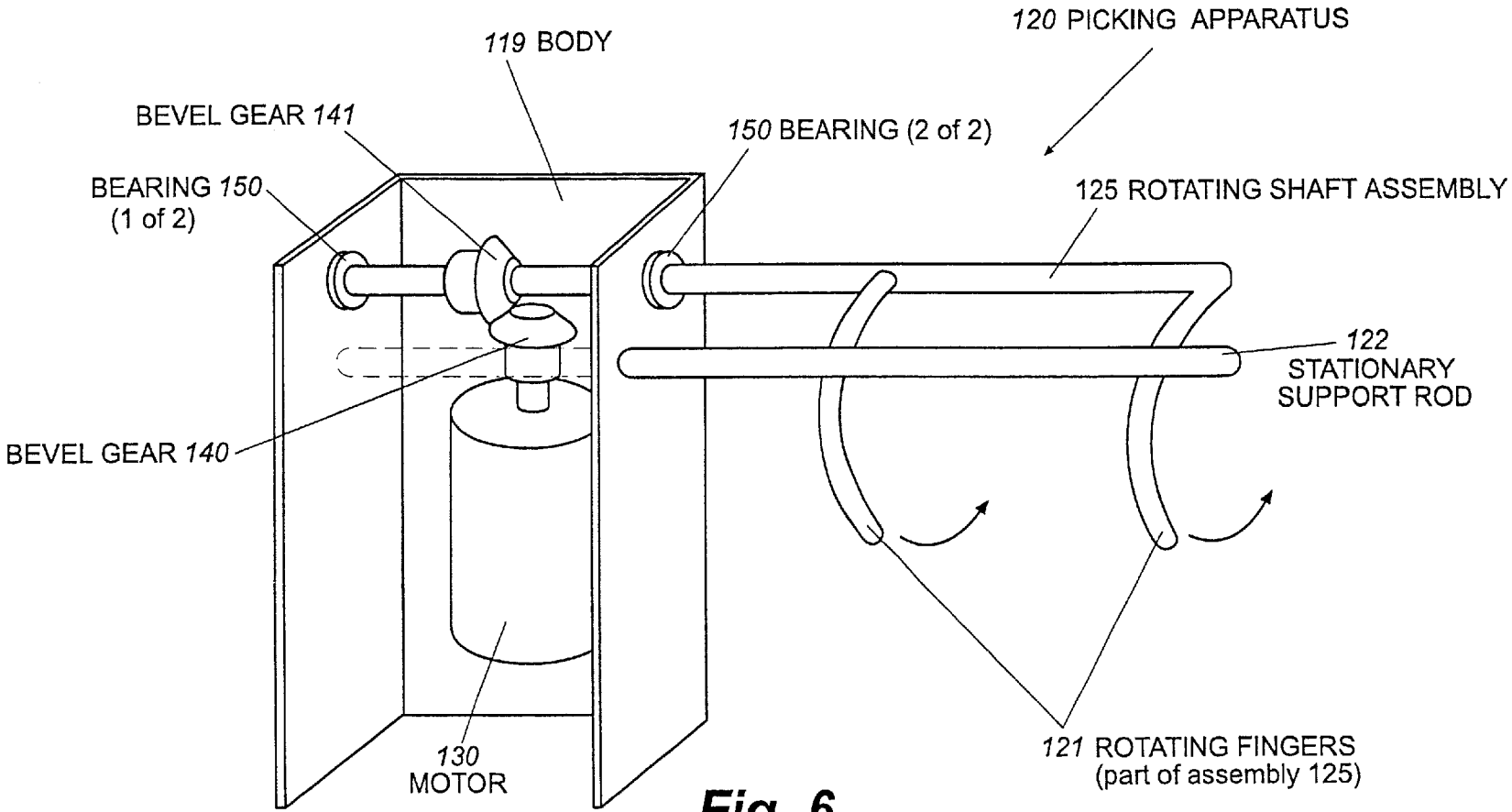
FIG. 6 is an isolated pictorial view of an alternate picking assembly 120. This picking assembly 120 includes a body 119, a rotating shaft assembly 125 having two rotating fingers 121, a stationary support rod 122, a motor 130, a beveled gear 140, a beveled gear 141, and a pair of bearings 150.

FIG. 6 is an isolated pictorial view of an alternate picking assembly 120. This picking assembly 120 includes a body 119, a rotating shaft assembly 125 having two rotating fingers 121, a stationary support rod 122, a motor 130, a beveled gear 140, a beveled gear 141, and a pair of bearings 150.

The body 119 is generally "U-shaped" in transverse cross-section, having a main portion and two sidewall portions extending in the same direction from opposing edges from the main portion. These two sidewall portions are substantially planar and coparallel. The two sidewall portions and the main portion combine to form a partially enclosed concealment space for location of a drive motor 130 and other elements discussed elsewhere.

The stationary support rod 122 is substantially rigidly attached relative to one of the side walls of the body 119, and is configured to cooperate with the rotating shaft 125 as discussed in detail latter.

The rotating shaft assembly 125 includes two rotating fingers, each designated 121. When suitably manipulated, these two rotating fingers cooperate to support an elongate product 11 such as those shown in FIG. 1, and such as shown in phantom in a cradled position in FIG. 7.

The rotating shaft assembly 125 is rotatably mounted relatively to the body 119 of the picking assembly 120 by use of pair of bearings 150. One bearing is located within each of the side walls, and is configured to accept the rotating shaft assembly 125 to allow suitable rotation of the rotating shaft assembly 125 relative to the body 119.

A beveled gear 141 is rigidly attached to and is part of the rotating shaft assembly 125, at a location along the rotating shaft assembly 125 intermediate the two bearings 150. The beveled gear 141 is configured to mate with beveled gear 140, which is rotatably driven by a motor 130, such that rotation of the motor 130 causes rotation of the rotating shaft assembly 125.

By suitable control of the motor 130 as known in the art, the rotating shaft assembly 125 may likewise be suitably controlled, such that its rotational position, rotational speed, and rotational direction may all be suitably controlled via electronics or other suitable means known in the art.

The motor 130 can be any type suitable in the art, but in one configuration is contemplated to be a DC gearmotor or a stepper motor.

The main shaft of the rotating shaft assembly 125 may be seen to be substantially parallel to the stationary support rod 122, and in the preferred embodiment is substantially level with the rotating shaft 125.

In FIG. 6, the rotating shaft assembly 125 may be positioned in what could be thought as a "ready" position, such position being the position in which the picking assembly 120 is positioned when empty and in transit.

Figure 7:
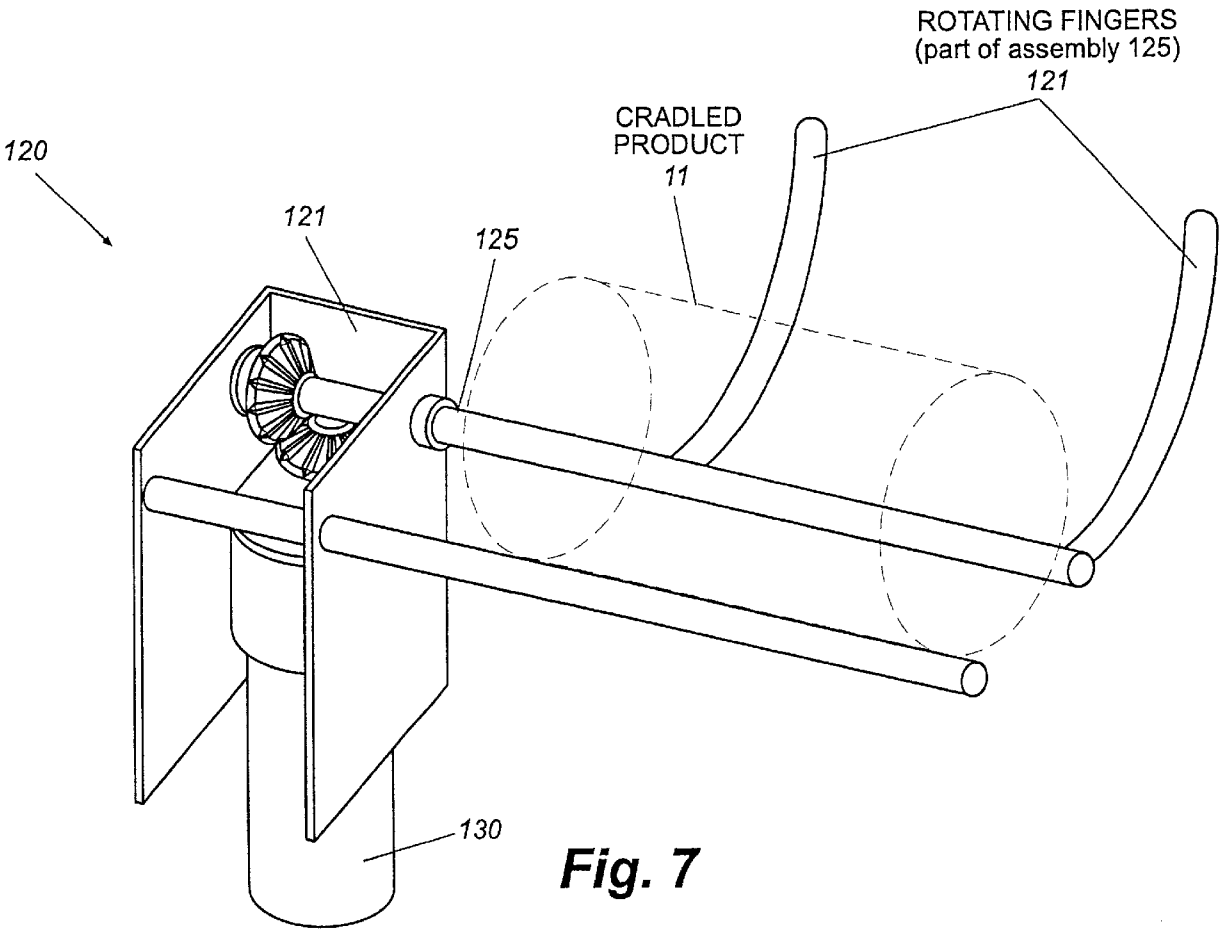
FIG. 7 is another view of the picking assembly 120 shown in FIG. 6, except in this configuration, the rotating shaft assembly 125 has been rotated to a different position. This position may be thought as the position in which the product 11 is "dropped" into the cradle provided by the members 125, 122.

FIG. 7 is another view of the picking assembly 120 shown in FIG. 6, except in this configuration, the rotating shaft assembly 125 has been rotated to a different position. This position may be thought as the position in which the product 11 has been picked is "dropped" into the cradle provided by the members 125, 122. In this position the previously-described "blocking" feature can likewise be performed by the rotating fingers 121.

It may be understood that once the product has been rolled in place in the cradle provided by members 125, 122, the rotating shaft assembly 125 preferably may be rotated back to the position in FIG. 6 without disturbing the product cradled thereby. This can be done just before the product gets "stripped", as noted in more detail elsewhere.

Figure 8:
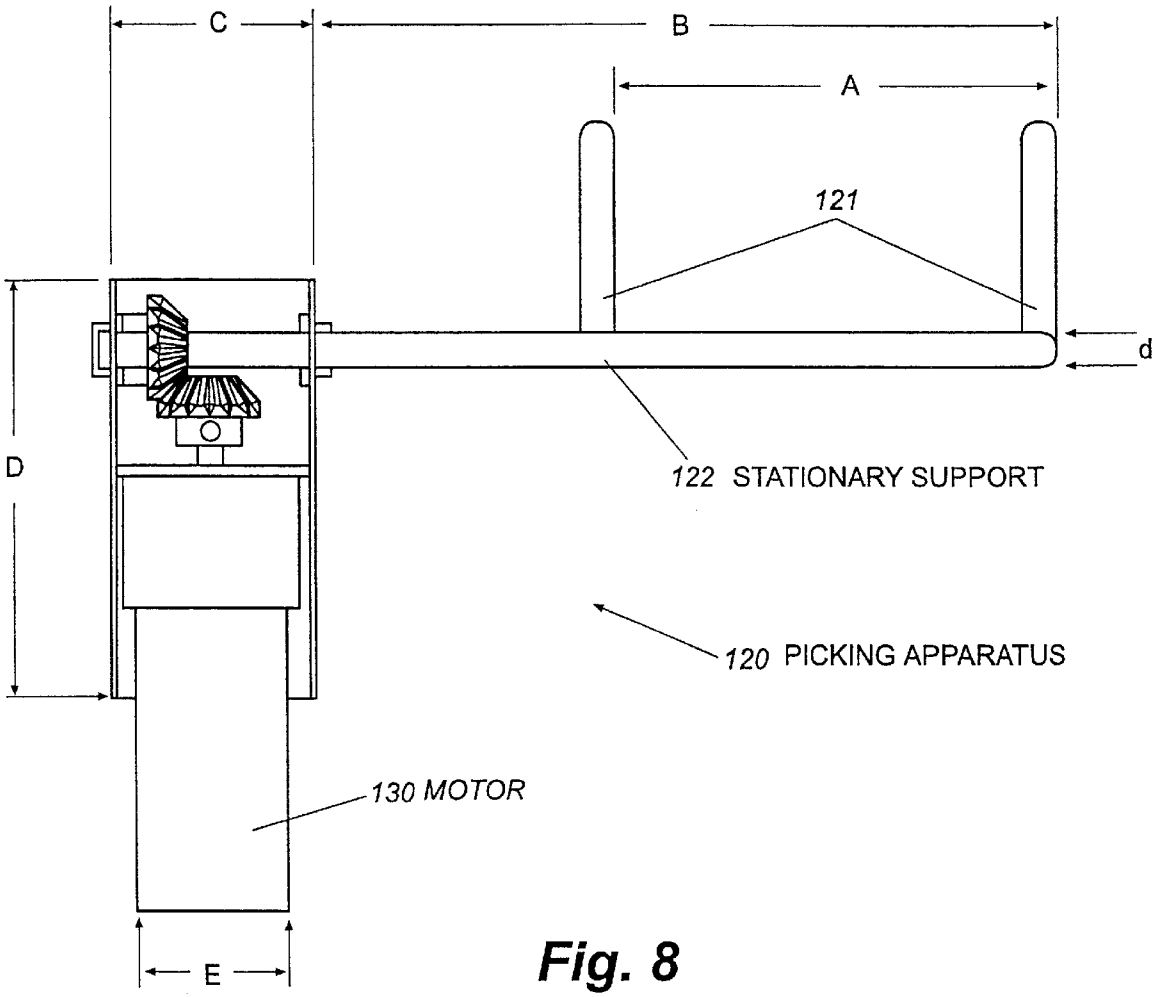
FIG. 8 is a front elevational view of the apparatus of FIGS. 7 and 6.

FIG. 8 is a front elevational view of the apparatus of FIGS. 7 and 6, with certain dimensions, although not absolutely critical to the operation of the invention, being noted as the result of planning by the inventor.

In FIG. 8, dimension A can be 3.375 inches. Dimension B can be 5.658 inches. Dimension C can be 1.600 inches. Dimension D can be 3.0 inches. Dimension E can be 1.175 inches. The diameter "d" of the stationary support rod 122 and the main elongate rod of the rotating shaft 125 can be in each instance 0.250 inches.

Apparatus 200 and The Cable Assemblies

Figure 9:
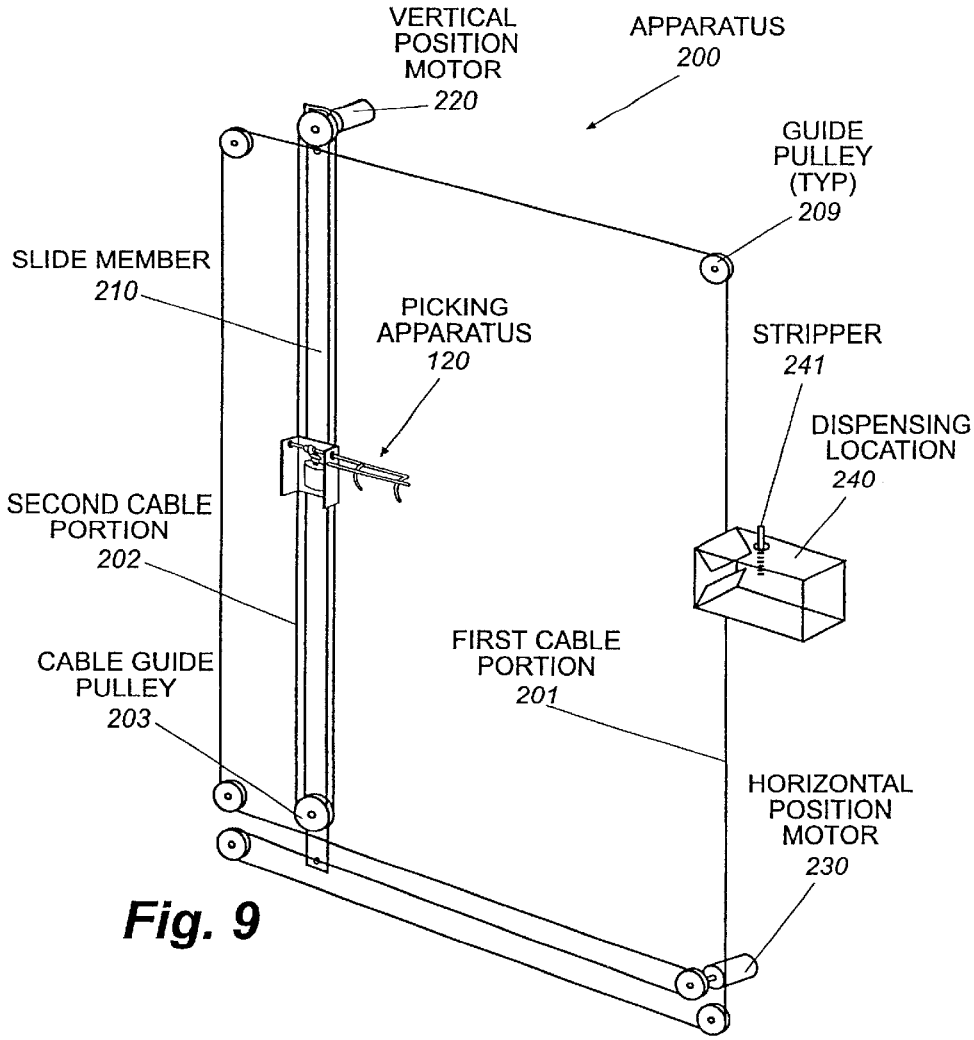
FIGS. 9 and 10 are illustrative views of portions of an apparatus 200 which facilitate movement of a picking apparatus 120 within same.
Figure 10:
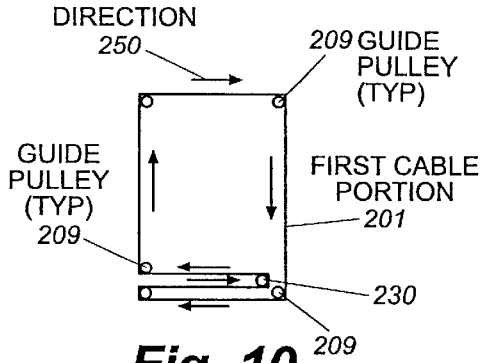

FIGS. 9 and 10 illustrate one means in which the apparatus 120 of FIGS. 6–8 may be moved about a larger supporting apparatus 200. This larger supporting apparatus 200 includes a first cable portion 201, and a second cable portion 202. Further included is a slide member 210, a vertical position motor 220, a horizontal position motor 230, and a dispensing location 240. As discussed in detail later, the vertical position motor 220 moves the picking assembly 120 in the vertical direction, whereas the horizontal positioning motor 230 moves the picking assembly 120 in the horizontal direction, all by use of first and second cable portions 201 and 202.

Figure 11:
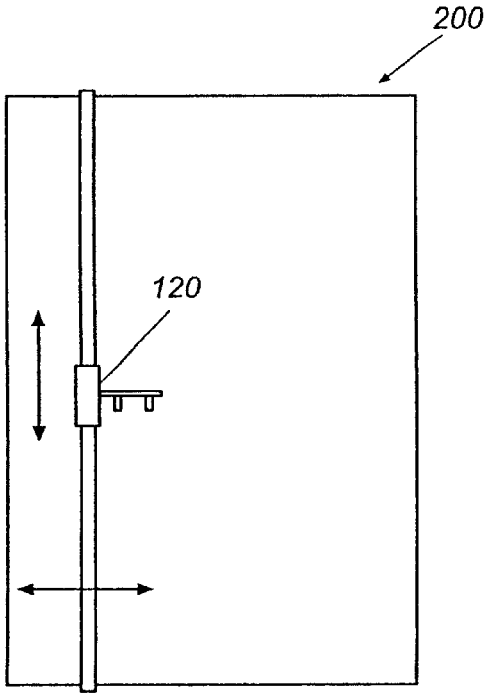
FIG. 11 is a simplified front elevational version showing operation of the apparatus 200 used with the picking apparatus 120, mainly for comparison with FIGS. 12–14.

The first cable portion 201 is substantially endless in function, although in practice it can be a single length of cable, cord, or other suitable flexible material having each of its ends attached to a common movable element. Reference is made to both FIGS. 9 and 10 to illustrate the path of the first cable portion 201, which is defined by a plurality of conventional guide pulleys 209, and a motor 230 pulley, all of which are rotatably mounted relative to the frame of the supporting apparatus 200. This frame is not shown in FIGS. 9 or 10 but is generally shown in FIG. 11. In one embodiment, the ends of the first cable portion 201 are attached to the elongate slide member 210, discussed below. Operation of the horizontal positioning motor 230, which includes a drive pulley engaging the first cable portion 201, moves the picking assembly 120 in the horizontal direction as discussed in more detail below.

The picking assembly 120 is slidably mounted relative to the slide member 210, such that the picking assembly 120 can slide up and down the elongate slide member 210, subject to the constraints of the second cable portion 202 as discussed below. Vertical position motor 200 is attached relative to the slide member 210 and moves horizontally therewith.

The second cable portion 202 is substantially endless in its function, although in practice it can be a single length of cable, cord, or other suitable flexible material having each of its ends attached to a common movable element. This common movable element could be the picking assembly 120, such that rotation of the vertical position motor 220 causes movement, either up or down, of the picking assembly 120. The second cable portion 202 is supported by two pulleys, a cable guide pulley 203 rotatably mounted to the lower end of the slide member 210, and a drive pulley being part of the vertical position motor 220.

By suitable control of the vertical position motor 220, the vertical positioning of the picking assembly 120 can likewise be controlled.

The elongate slide member 210 has an upper end attached relative to the first cable portion 201, and a lower portion attached relative to the first cable portion 201. Referring now also to FIG. 10, by use of the direction arrows 250, one can see that the cable portions to which the slide member 210 is attached move in generally the same direction, such that movement of the first cable portion 201 causes the slide member 210 to likewise move in a particular horizontal direction at the same speed as the cable 201.

As the horizontal position motor 230 drives the first cable portion 201, the slide member 210 is likewise moved side-to-side depending upon the rotation of the horizontal position motor 230. Thus, if one assumes that the slide member moves generally to the right, it may likewise be understood that the picking assembly 120 will also be moved to the right, along with the vertical position motor 220.

Should the vertical position of the picking assembly 120 desired to be varied, the vertical position motor 220 is similarly operated.

Therefore it may be seen that the vertical position motor 220 moves the picking assembly 120 in the vertical direction, whereas the horizontal positioning motor 230 moves the picking assembly 120 in the horizontal direction.

Use of Dispensing Location

After the picking assembly 120 has picked a product 11 and has cradled it as shown in FIG. 7, the picking assembly 120 may then be moved generally towards the dispensing location 240, for deposit therein to be removed by the consumer.

As may be seen, the picking assembly 120 as shown in, for example, FIG. 7, is somewhat of a "cantilevered" design, in that the cradled product 11 is positioned to the side of the body 119 of the device. Therefore, it may be seen that this "cantilevered" design makes it possible for the cradled product (as well as the supporting fingers 120, a portion of the rotating shaft 125, and a portion of the stationary support rod 122), to be inserted into the dispensing location 120.

Once the cradled product is within the dispensing location 120, the product may then be withdrawn by the consumer with the product still cradled. However, in the preferable alternative, the product may be "stripped" from the picking assembly 120 by suitable means which causes the cradle product to be stripped off of its cradled position as the picking assembly 120 is withdrawn from the dispensing location 120 and back into its picking zone. The consumer could then reach in and grasp the product. If desired suitable barriers could be provided to prevent consumers from being able to reach in and contact the moving assembly 120.

It should be understood that the dispensing location 240 can include in inlet flap to allow some separation of the picking zone (which may be refrigerated) to the dispensing zone (which may not be refrigerated). Such a flap (or flaps) could be used to provide the stripping function, by being configured as "one-way" flaps which pivot inwardly into the dispensing location cavity, but not outwardly.

Alternatively, on "interference member" could be selectively moved from above, below, or to the side of the position of the cradled product, to provide a stripping function.

Other Alternates

Figure 12:
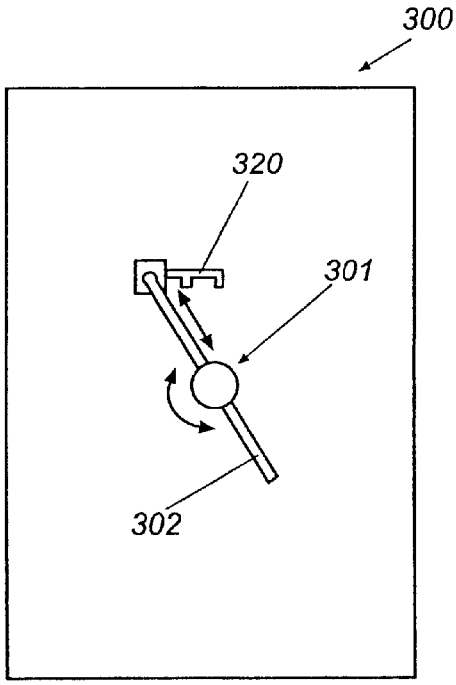
FIG. 12 shows an alternate version 300, which includes the use of a central supporting shaft 301, which moves a rod 302 along its axis, and has a picking assembly 320 attached to its end. By rotational of the central shaft 301 and extension or withdrawal of the captured rod 302, the picking assembly 320 may be moved to suitable locations within the rectangle which designates the general picking zone.

Reference is now made to FIGS. 11–12, which show the apparatus 200 as well as alternate apparatuses 300, 400, and 500.

Figure 13:
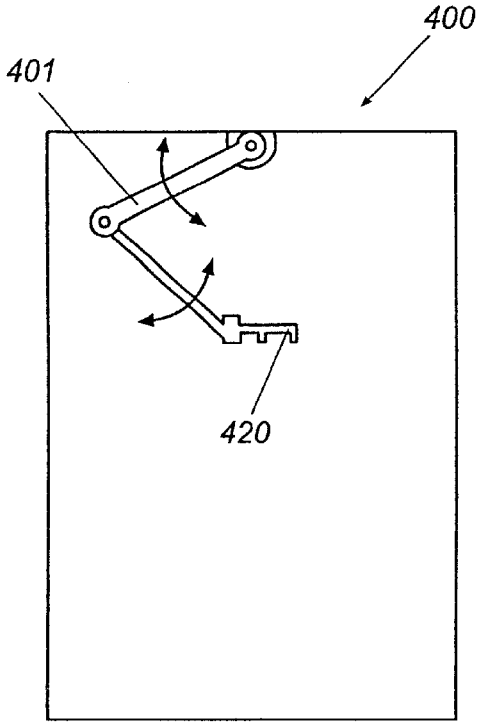
FIG. 13 shows an alternate version 400, showing the use of an articulating arm assembly 401 supporting a picking assembly 420. The articulating arm assembly is mounted to the frame of the overall apparatus outside of the picking zone.
Figure 14:
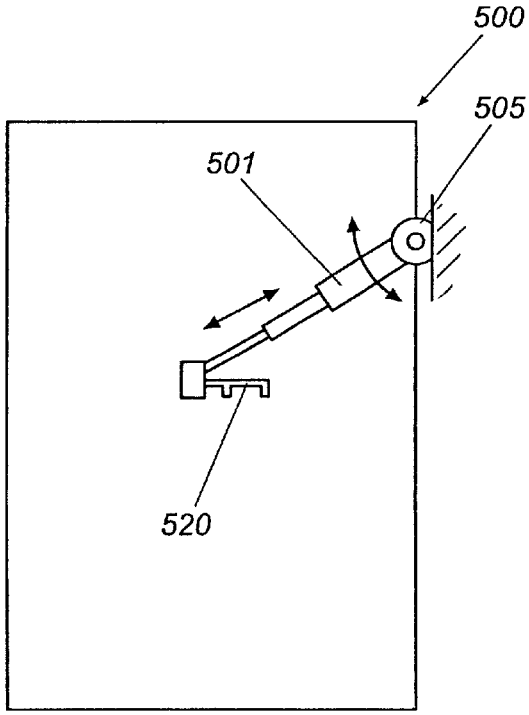
FIG. 14 shows yet another possible embodiment 500, in which a telescopic arm assembly 501 supports at its free end a picking assembly 520 but said telescopic arm assembly 501 is supported relative to the frame of the assembly along pivot point 505.

FIG. 11 is a simplified front elevational version showing operation of the apparatus 200 used with the picking apparatus 120, mainly for comparison with FIGS. 12–14.

FIG. 12 shows an alternate version 300, which includes the use of a central supporting shaft 301, which moves a rod 302 along its axis, and has a picking assembly 320 attached to its end. By rotational of the central shaft 301 and extension or withdrawal of the captured rod 302, the picking assembly 320 may be moved to suitable locations within the rectangle which designates the general picking zone.

FIG. 13 shows an alternate version 400, showing the use of an articulating arm assembly 401 supporting a picking assembly 420. The articulating arm assembly is mounted to the frame of the overall apparatus outside of the picking zone.

FIG. 14 shows yet another possible embodiment 500, in which a telescopic arm assembly 501 supports at its free end a picking assembly 520 but said a telescopic arm assembly 501 is supported relative to the frame of the assembly along pivot point 505.

Figure 15:
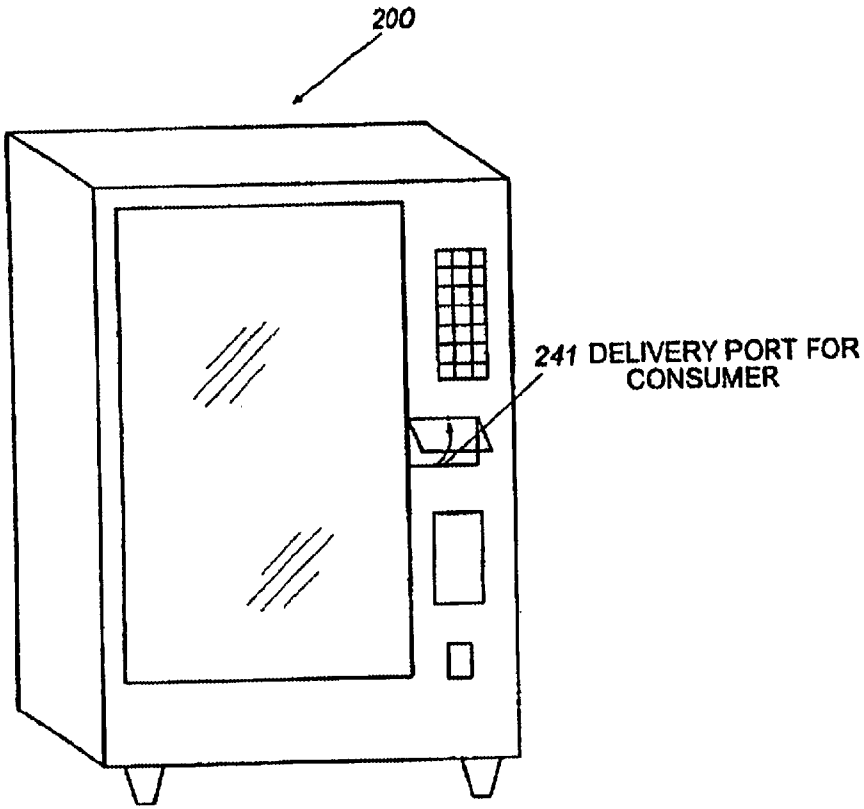
FIG. 15 shows a vending assembly 200 contemplated by the configuration shown in FIGS. 6–10.

FIG. 15 shows a vending assembly 200 contemplated by the configuration shown in FIGS. 6–10. This vending assembly 200 includes a delivery port 241 into which the consumer can place his/her hand to withdraw the product from the dispensing location.

Figure 16:
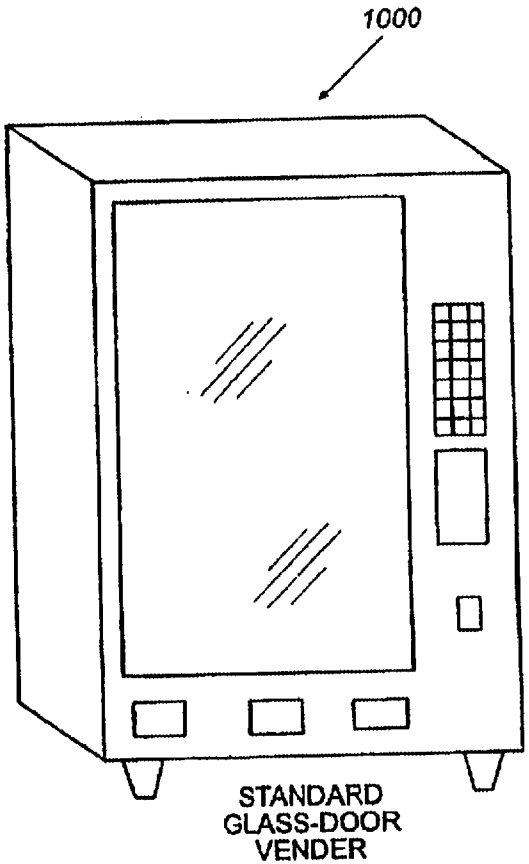
Fig. 16 PRIOR ART
FIG. 16. shows a prior art vending assembly 1000 for reference purposes. Note the dispensing location at the bottom, which is different in location from that shown in FIG. 15.

FIG. 16 shows a prior art vending assembly 1000 for reference purposes.

As noted above, in another alternate configuration the fingers could be independent with each other and at one point one or the other of the fingers could move upwardly, causing tilting to either side.

A "two way" picker could also be used with a hand-like grip. The products could also be standing when gripped with this type of gripper.

As noted above, an option which may be used with the present invention includes the use of "variety packs", which can be provided by filling the variety pack with different products within the vendor. The holder can dump products into different slots with in the six pack, and the six pack guide member can include slots to allow clearance of the apparatus.

It may also be understood that some "entertainment value" may be derived from use of the machine. As noted above, the X-Y picker will move in view of the user prior to making its picking selection. If so desired, the X-Y picker could be programmed to "follow" the hand of a user should the user place his or her hand on the front glass. In such a situation, the user could move his or her hand on the front glass, and the X-Y picker could effectively follow the hand. If so desired, the apparatus could also be programmed to select the item corresponding to the point at which the user removed his or her hand from the front glass.

It should also be understood that the vending apparatus according to the present invention could also go through movements while it is not being used. In such an instance, the X-Y picker could move through the X and Y axes (without picking) to draw the attention of the user.

Conclusion

Therefore it may be seen that the present invention provides an improvement over the prior art by providing a vending machine for vending articles, most notably beverage or food containers. More particularly, the present invention relates to a vending machine having a cabinet with a plurality of vertically spaced shelves, and an "X-Y" picker assembly for receiving a packaged beverage from a shelf and for delivering the packaged beverage to a delivery port in a front face of the cabinet, or to another location as desired.

While this invention has been described in specific detail with reference to the disclosed embodiments, it will be understood that many variations and modifications may be effected within the spirit and scope of the invention as described in the appended claims.

What is claimed is:

1. An apparatus for storing and dispensing a plurality of products, said apparatus comprising:

a frame;

a plurality of storage locations for storing said products;

a discharge location; and a picking apparatus, said picking apparatus comprising a rotating member such that said picking apparatus separates one of said products from said plurality of products and transports said one of said products to said discharge location.

2. The apparatus as claimed in claim 1, wherein said rotating member is configured to be rotated such that it separates a first product from said plurality of products while at the same time blocking removal of a second product from said plurality of products.

3. The apparatus as claimed in claim 1, wherein said picking apparatus is configured to move independently along two substantially perpendicular axes relative to said frame.

4. The apparatus as claimed in claim 1, wherein said picking apparatus comprises a plurality of stationary fingers, said stationary fingers cradling said one of said products during transport.

5. The apparatus as claimed in claim 1, wherein said plurality of storage locations comprises a plurality of gravity-fed storage locations for storing said products.

6. The apparatus as claimed in claim 1, wherein at least one of said plurality of storage locations comprises a comb-like set of projecting fingers defining elongate open-ended gaps therebetween, said projecting fingers at least partially supporting at least one of said products in a picking position; and wherein said picking apparatus comprises at least one finger configured to pass through at least one of said elongate open-ended gaps when said one of said products is picked from said picking position.

7. The apparatus as claimed in claim 1, further comprising:

a discharge location; and a multi-cavity container;

said multi-cavity container comprising a plurality of storage locations;

said discharge location configured to accept said multi-cavity container while allowing said multi-cavity container to be removed; and wherein said picking apparatus transports said one of said products to said multi-cavity container.

8. The apparatus as claimed in claim 1, further comprising:

an elongate slide member mounted for movement relative to said frame along a first axis;

said picking apparatus slidably mounted relative to said elongate slide member along a second axis relative to said frame;

a first cable assembly for moving said slide member along said first axis; and a second cable assembly for moving said picking apparatus along said second axis relative to said frame;

such that said first and second cable assemblies of said dispensing apparatus may be operated such that said picking apparatus is moved relative to said frame along either or both of said first and second axes, to withdraw said products from said storage locations, transport them singularly for a distance, and dispense them into said discharge location.

9. An apparatus for storing and dispensing a plurality of products, said apparatus comprising:

A) a first frame;

B) a plurality of storage locations for storing said products;

C) a discharge location;

D) a picking apparatus configured to withdraw said products from said storage locations, transport them singularly for a distance, and dispense them into said discharge location, said picking apparatus itself comprising:

1) a second frame movable relative to said first frame in at least two directions;

2) a cradling member attached to said second frame, said cradling member configured at least to assist in the cradling of one product during said transport;

3) a rotating member including at least one picking finger, said rotating member configured to rotate from a first position to a second position to a third position;

4) a first motor for rotating said rotating member from said first position to said second position such that said finger separates said first product from said second product, and for further rotating said rotating member to said third position such that said finger urges said product into a cradled position in contact with said cradling member; and E) a second motor for moving said second frame along at least one of said two directions relative to said first frame.

10. The apparatus as claimed in claim 9, wherein said cradling member comprises a stationary rod attached to said second frame.

11. The apparatus as claimed in claim 9, wherein said cradling member cooperates with a portion of said rotating member to combine to cradle said product.

12. The apparatus as claimed in claim 9, wherein said rotating member further includes an elongate body portion having said picking finger attached thereto, said first motor configured to rotate said elongate body portion about its elongate longitudinal axis.

13. The apparatus as claimed in claim 9, wherein said finger separates said first product from said second product while at the same time said finger blocks removal of said second product.

14. The apparatus as claimed in claim 9, wherein said cradling member is configured to assist in the cradling of one of said product during said transport.

15. An apparatus for storing and dispensing a plurality of products, said apparatus comprising:

a plurality of storage locations for storing said products;

a discharge location; and a picking apparatus;

said picking apparatus comprising a rotating member such that said picking apparatus removes one of said products from said plurality of products;

said picking apparatus comprising means to transport said one of said products to said discharge location.

16. The apparatus of claim 15, wherein said picking apparatus comprises a stationary support, said stationary support assisting in cradling said one of said products during transport.

17. The apparatus of claim 15, wherein said transport means comprises an X-Y traverse assembly.

18. The apparatus of claim 15, wherein said transport means comprises a pulley system.

19. The apparatus of claim 15, wherein said transport means comprises a rotating arm.

20. The apparatus of claim 15, wherein said transport means comprises an articulating arm.

21. The apparatus of claim 15, wherein said transport means comprises a telescopic arm.

* * * * *